US005078623A

United States Patent [19]

Wang

[11] Patent Number: 5,078,623

[45] Date of Patent: * Jan. 7, 1992

[54] STRUCTURE OF PASSIVE ELECTRIC CONNECTOR

[76] Inventor: Tsan-Chi Wang, No. 13, Alley 312, Chung Cheng Road, Hsin Tien City, Taiwan

[ * ] Notice: The portion of the term of this patent subsequent to Aug. 27, 2008 has been disclaimed.

[21] Appl. No.: 574,040

[22] Filed: Aug. 29, 1990

[51] Int. Cl.[5] ..... H01R 13/66; H01R 13/52

[52] U.S. Cl. ..... 439/620; 439/108; 439/276; 338/220

[58] Field of Search ..... 439/620, 95, 96, 97, 439/108, 92, 936; 361/220, 212; 338/220, 221

[56] References Cited

U.S. PATENT DOCUMENTS 3,744,128 7/1973 Fisher et al. ..... 439/936
4,826,451 5/1989 Cunningham ..... 439/936
4,961,711 10/1990 Fujiura et al. ..... 439/610

FOREIGN PATENT DOCUMENTS 272039 6/1988 European Pat. Off. ..... 439/276

*Primary Examiner*—Gary F. Paumen
*Attorney, Agent, or Firm*—Varndell Legal Group

[57] ABSTRACT

Disclosed is a passive electric connector, which comprises a BNC (Bayonet Navy Connector) socket holder, a BNC terminal plug and a chain connected therebetween. The BNC socket holder includes two opposite shells made of regular channel plate covered with a layer of soft plastic material and respectively connected together to form a closed housing for mounting four BNC sockets. There are provided four resistors each having one end respectively connected to the BNC sockets inside the housing and an opposite end respectively connected together. The housing is stuffed with a non-conductive packing material which covers the resistors and some parts of the BNC sockets and portion of a chain which extends inside the housing.

10 Claims, 3 Drawing Sheets

STRUCTURE OF PASSIVE ELECTRIC CONNECTOR

BACKGROUND OF THE INVENTION

The present invention is related to a structure of passive electric connector which can effectively protect against radio frequency interference, electric magnetic interference and electric induction.

A regular passive electric connector generally comprises a BNC (Bayonet Navy Connector) socket holder inserted in a metal or plastic casing and firmly secured thereto by a screw bolt. After the resistors are connected, a bottom cover is attached to the metal or plastic casing. Disadvantages of this conventional type of passive electric connector are numerous and outlined hereinafter.

1) If a plastic casing is used, it can be easily damaged or trampled down by foot.

2) If a metal casing is used, one's toes may be hurt when it is kicked by one's foot.

3) Because the BNC sockets are connected to a casing by screw bolts, the BNC may easily become loose after a certain period of time in use.

4) The welding connection of the resistors inside a metal casing is difficult to perform.

5) A gap can be present between a casing and a bottom cover, so as to cause transmission errors due to permeation of water.

6) A plastic casing can not protect against electric magnetic interference or radio frequency interference.

7) A metal casing can cause an electric induction problem.

8) When the BNC socket holder is not in use and exposed outside, contact with hands or electric magnetic interference may interfere with computer operation.

SUMMARY OF THE INVENTION

One of the objects of the present invention is to provide a passive electric connector which can effectively protect against electric magnetic interference or radio frequency interference.

Another object of the present invention is to provide a passive electric connector which is durable in use and can protect against damage.

Still another object of the present invention is to provide a passive electric connector which can firmly secure a BNC connector to a BNC socket holder.

Still another object of the present invention is to provide a passive electric connector which is convenient for mounting a resistor through a welding process.

Still another object of the present invention is to provide a passive electric connector which can protect against permeation of water.

A yet further object of the present invention is to provide a passive electric connector which can efficiently protect against electric induction.

According to the present invention, a passive electric connector is comprised of a BNC socket holder and a bayonet navy connector (BNC) terminal plug with a chain connected therebetween. The BNC socket holder comprises two opposite shells made of a regular channel plate covered with a layer of soft plastic material and respectively connected together to form a closed housing. Four BNC sockets are fastened in one of the two opposite shells, partly projecting out of the housing and partly extending inside the housing. There are provided four resistors having each an end respectively connected to the inner ends of the BNC sockets inside the housing with an opposite end respectively connected together. A non-conductive packing material is stuffed inside the housing to cover over the resistors and some parts of the BNC sockets and the chain which can extend inside the housing.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
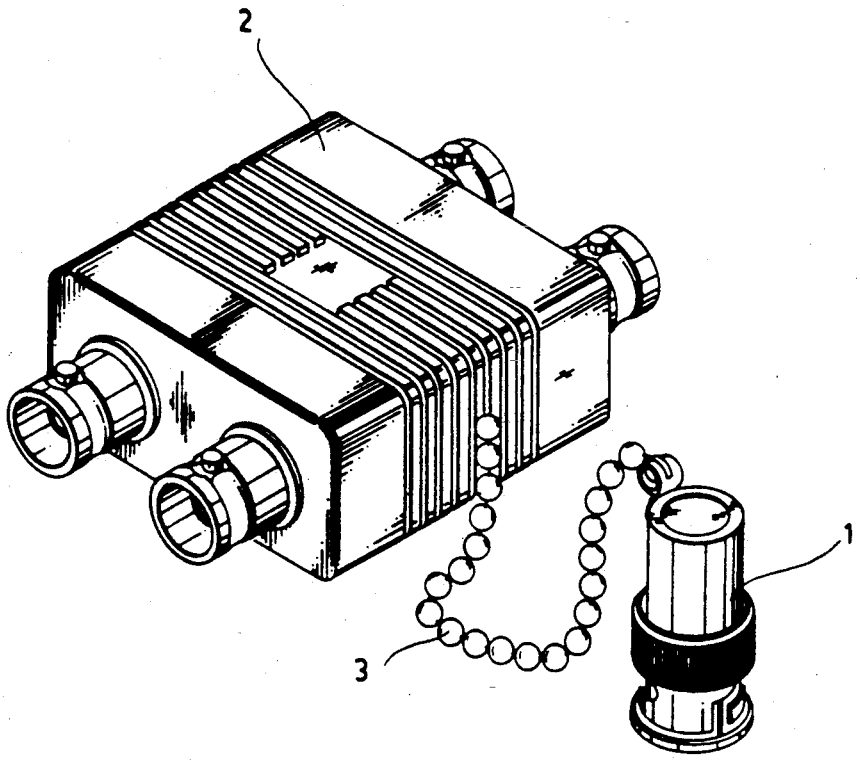
FIG. 1 is a perspective view of a passive electric connector device embodying the present invention.

Turning now to the annexed drawings in greater detail and referring first to FIG. 1, therein illustrated is a passive electric connector embodying the present invention and generally comprised of a BNC socket holder 2, a bayonet navy connector (BNC) terminal plug 1, and a metal chain 3 connected therebetween.

Figure 2:
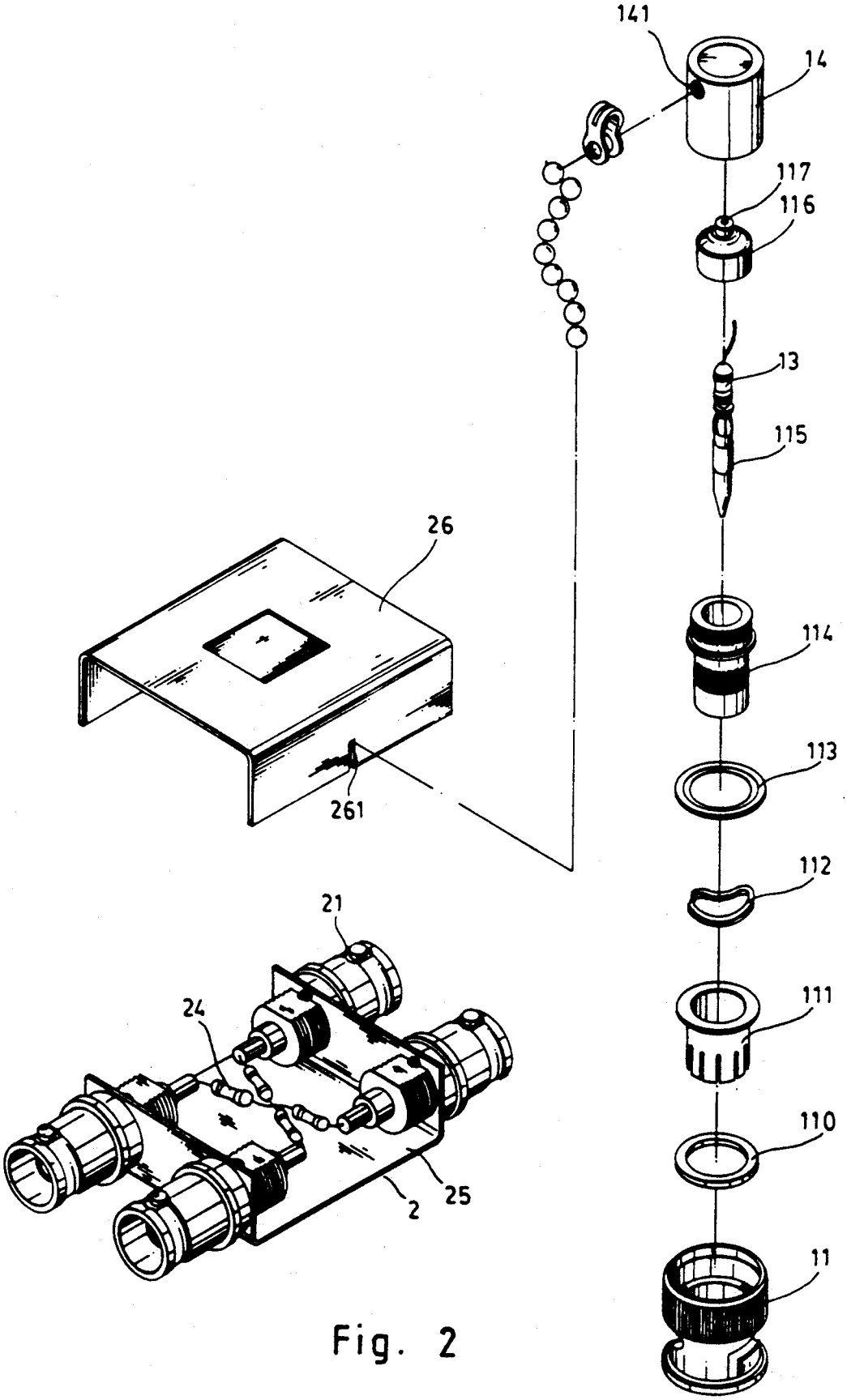
FIG. 2 is a perspective fragmentary view thereof.
Figure 3:
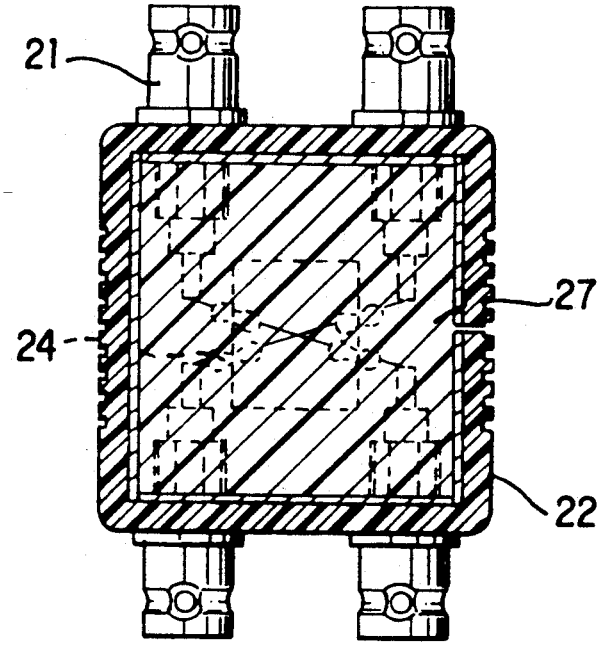
FIG. 3 is a transverse sectional view thereof.

Referring to FIGS. 2 and 3, a passive electric connector 2 comprises a housing formed of two opposite shells 25, 26, for mounting four BNC sockets 21. The BNC sockets 21 respectively partly project out of the housing of the connector 2. Four resistors 24 are provided each an end respectively connected to the terminal ends of the four BNC sockets 21 inside the housing of the connector 2 and an opposite end respectively connected together. A non-conductive flexible plastic packing material 27 is stuffed inside the housing of the connector 2 covering over the resistors 24 and the BNC sockets 21. The two opposite shells 25, 26 of the housing of the connector 2 are each made of a regular channel plates and respectively connected together through a welding process or any suitable connection process. After the two opposite shells 25, 26 are firmly together, the non-conductive flexible plastic packing material 27 is squeezed to firmly hold the BNC sockets 21 and the resistors 24 in position. Because the shells 25, 26 are made of regular channel plates, the process of soldering the resistors and the terminal ends of the BNC sockets 21 is more easy to perform.

According to the present invention, the two opposite shells 25, 26 are made of a metal material which can effectively protect against electric magnetic interference (EMI) or radio frequency interference (RFI), and respectively covered with a layer of soft covering 22 which serves as a cushion material and can efficiently protect against permeation of water. The soft covering 22 can be a plastic material which does not conduct electricity. Because the housing of the connector 2 is stuffed with non-conductive, flexible plastic packing material 27, the housing of the two opposite shells 25, 26 is protected from deformation or damage even if it is trampled by a foot.

One shell 26 of the housing of the connector 2 has a narrow opening 261 at one side for mounting a chain 3 to connect a BNC terminal plug 1 thereto. This chain 3 is used for grounding and eliminating radio frequency or static interference.

A BNC terminal plug 1 of the present invention comprises a holder device 11 for mounting in proper order a ring 110, a bushing 111, a rubber ring 112, a gasket 113, a rubber sleeve 114, a pull-down resistor 13, an inner metal cap 116 and an outer metal cap 14. The outer metal cap 14 secures the component parts inside the holder device 11 and has a side hole 141 for securing the chain 3 which is connected to the passive electric connector 2. The resistor 13 provides a suitable ohmic resistance and has a terminal 115 connected thereto at the bottom, which terminal 155 is inserted in the rubber sleeve. The resistor 13 has a conductor at the top which is inserted through a top hole 117 on the inner metal cap 116 and contacts the outer metal cap 14.

The above drawings and description are for the purpose of illustration only and not intended as a definition of the limits and scope of the invention disclosed. Recognizing that various modifications been apparent, the scope herein shall be deemed as defined in the claim as set forth hereinafter.

I claim:

1. A passive electric connector, comprising:

first and second shells of regular channel plates and connected together to form a closed housing, a layer of soft plastic material covering said housing for protection against permeation of water, four BNC sockets fastened to said first shell with an inner portion of said BNC sockets contained within said housing and an outer portion extending out of said housing four resistors contained in said housing each having one end respectively connected to a respective terminal of said four BNC sockets and an opposite end respectively connected together.

a chain having one end connected to said second shell and another end connected to a BNC terminal plug, and a non-conductive packing material contained within said housing and covering said resistors, said inner portions of said BNC sockets and said one end of said chain.

2. The passive connector of claim 1, wherein said BNC sockets are fastened to said first shell by welding.

3. The passive connector of claim 1, wherein said BNC sockets are fastened in said first shell through holes therein having sides and angles corresponding to a cross section of said BNC sockets.

4. The passive electric connector of claim 1, wherein said non-conductive packing material is rubber.

5. The passive electric connector of claim 1, wherein said non-conductive packing material is plastic.

6. The passive electric connector of claim 1, wherein said BNC terminal plug includes a holder for receiving a first ring, a bushing, a rubber ring, a gasket, a rubber sleeve, a pull-down resistor, an inner metal cap an an outer metal cap.

7. The passive electric connector of claim 1, wherein said BNC terminal plug includes a holder device having a single hole for securing said another end of said chain.

8. The passive electric connector of claim 1, wherein said BNC terminal plug includes a resistor having a bottom terminal.

9. The passive electric connector of claim 8, wherein said bottom terminal is inserted into a rubber sleeve contained within said BNC terminal plug.

10. The passive electric connector of claim 9, wherein said BNC terminal plug contains an inner and an outer cap and said resistor has a top terminal inserted through a hole in said inner cap so as to contact said outer cap.

* * * * *